US009434601B2

(12) United States Patent
Baker

(10) Patent No.: US 9,434,601 B2
(45) **Date of Patent: *Sep. 6, 2016**

(54) CIRCUMFERENTIALLY ADJUSTABLE DEVICE FOR TRANSFERRING FUEL ADDITIVES FROM CONTAINERS INTO CAPLESS FUEL SYSTEMS

(71) Applicant: William Edward Baker, Marietta, GA (US)

(72) Inventor: William Edward Baker, Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/986,827

(22) Filed: Jan. 4, 2016

(65) Prior Publication Data

US 2016/0115010 A1 Apr. 28, 2016

Related U.S. Application Data

(63) Continuation-in-part of application No. 13/724,118, filed on Dec. 21, 2012, now Pat. No. 9,266,707.

(60) Provisional application No. 62/251,155, filed on Nov. 5, 2015.

(51) Int. Cl.

| | |
|---|---|
| ***B67D 7/42*** | (2010.01) |
| ***B67D 7/02*** | (2010.01) |
| ***B65D 1/02*** | (2006.01) |
| ***B65D 25/48*** | (2006.01) |
| ***B67C 11/02*** | (2006.01) |

(52) U.S. Cl.

CPC ..... *B67D 7/42* (2013.01); *B65D 1/023* (2013.01); *B65D 25/48* (2013.01); *B67C 11/02* (2013.01); *B67D 7/0288* (2013.01)

(58) Field of Classification Search

CPC ..... B65D 25/40; B65D 25/42; B65D 25/46; B65D 25/48; B65D 5/746; B67C 2011/027; B67C 11/02; B67D 7/0288; B67D 7/42; B67D 7/005

See application file for complete search history.

(56) References Cited

U.S. PATENT DOCUMENTS

| | | | | | |
|---|---|---|---|---|---|
| 1,428,297 | A * | 9/1922 | Price | B65D 47/06 | 222/478 |
| 2,309,385 | A * | 1/1943 | Fleming | B65D 41/12 | 215/307 |
| D241,597 | S * | 9/1976 | Confer et al. | 141/331 | |
| 4,492,324 | A * | 1/1985 | Weber | B65D 25/44 | 222/529 |
| 5,065,913 | A * | 11/1991 | Glasener | B67C 11/02 | 222/1 |
| 5,092,498 | A * | 3/1992 | Willems | B65D 25/50 | 222/526 |
| 5,131,571 | A * | 7/1992 | Nolley | B65D 47/06 | 222/1 |
| 5,228,488 | A * | 7/1993 | Fletcher | B67C 11/04 | 141/331 |
| 5,400,928 | A * | 3/1995 | Resnick | B65D 25/2894 | 206/446 |
| 6,340,038 | B1 * | 1/2002 | Ingram | B67C 11/02 | 141/333 |

(Continued)

*Primary Examiner* — Nicholas J Weiss
(74) *Attorney, Agent, or Firm* — Carla Gannon Law

(57) ABSTRACT

Devices that assist in transferring liquid from commercially available fuel additive containers into capless fuel system intakes generally include an enlarged mouth portion and a narrower nozzle portion, with the mouth portion detachably engaging with an additive container, and the nozzle portion inserted into a capless fuel system intake, such that the capless fuel system's opening flap is held in the opened position. The mouth of the device includes a plurality of hinge points that permit circumferential enlargement of the aperture, thereby allowing the device to form a substantially leak-proof frictional engagement with the neck of fuel additive containers having different diameters. In this manner devices can be used with almost all additive containers, regardless of the type, size and/or manufacturer. The device may include at least one flexible region on the nozzle.

18 Claims, 10 Drawing Sheets

(56) References Cited

U.S. PATENT DOCUMENTS 6,431,415 B1 * 8/2002 Schreiber ..... B65D 25/48 222/460
8,118,198 B1 * 2/2012 Watson ..... B65D 25/48 222/462
8,727,187 B2 * 5/2014 Magley, II ..... B65D 47/32 222/481.5
2003/0000973 A1 * 1/2003 Martin ..... B65D 47/065 222/528
2011/0297706 A1 * 12/2011 Zoss ..... B65D 39/0029 222/567
2013/0092292 A1 * 4/2013 Arnold ..... B65B 67/04 141/331
2013/0319572 A1 * 12/2013 Zweifel ..... B67D 7/42 141/1

* cited by examiner

CIRCUMFERENTIALLY ADJUSTABLE DEVICE FOR TRANSFERRING FUEL ADDITIVES FROM CONTAINERS INTO CAPLESS FUEL SYSTEMS

CROSS-REFERENCE TO RELATED APPLICATIONS

This application is a continuation-in-part of U.S. patent application Ser. No. 13/724,118, filed Dec. 21, 2012, entitled "CIRCUMFERENTIALLY ADJUSTABLE DEVICE FOR TRANSFERRING FUEL ADDITIVES FROM CONTAINERS INTO CAPLESS FUEL SYSTEMS", and claims the benefit of U.S. Provisional Patent Application No. 62/251,155, filed Nov. 5, 2015, entitled "POURING DEVICES WITH FLEXIBLE NOZZLES".

BACKGROUND OF THE INVENTION

The present inventions relate to pourable matter delivery devices, and more specifically, to pouring devices that assist in transferring liquid from bottles into fuel tanks of capless fuel systems. One embodiment includes a circumferentially expandable mouth for accommodating fuel additive container necks having a range of sizes, and a nozzle that can be inserted into a capless gas system. The nozzle of the device may have a flexible region, preferably constructed of collapsible bellows that bend and stay in position.

Many vehicle operators utilize fuel additives in order to modify or improve certain characteristics such a gasoline's octane rating, or act as a corrosion inhibitor or lubricant. An example of a common and commercially available fuel additive is STP® brand "Gas Treatment". Fuel additives typically include components such as metal deactivators, corrosion inhibitors, oxygenates and antioxidants. Typically a user purchases a fuel additive in a container having an elongated neck that terminates in the container opening. This design allows many fuel additive users to simply remove the container cap, direct the opening of the container into the gas tank opening, and pour in the contents. The specific size and shape of the container varies by manufacturer and product.

The addition of fuel additives into capless gas systems, however, is more complicated. In general, a capless gas system does not have a cap, but rather a self-sealing mechanism at the point of entry of fuel for a fuel tank. This self-sealing mechanism is typically a spring-loaded interior lid that allows entry of a standard fuel-pump nozzle having the correct corresponding fuel type, but remains shut when a nonstandard fuel-pump nozzle, or the wrong type of fuel-pump nozzle, attempts to gain entry. By way of example, the capless system of a vehicle that runs on diesel wouldn't allow entry of a non-diesel fuel gas nozzle. Capless gas systems are gaining in popularity with automobile manufacturers because of their ability to prevent fuel theft, and because they greatly reduce environmental hazards such as fuel spillage and evaporation that arise from improperly tightened or otherwise defective gas caps.

However, since capless gas systems are designed to prevent the introduction of substances into the gas tank using a nonstandard nozzle or spout, it is not possible to introduce fuel additives to capless gas systems using standard fuel additive containers. As a result, motorists having capless gas systems either can't use fuel additives, or experience great difficulty if they attempt to use a standard fuel additive container to introduce the fuel additive into their gas tank. Spillage of these liquids can be hazardous to both people and the environment.

In order to resolve such issues, there is a need for a device that facilitates the introduction of fuel additives into capless gas systems. It is desirable that this device can be used with a variety of fuel additive containers, and particularly with a range of neck diameters and openings. It is desirable that this device is capable of achieving a frictional fit including a tight seal that is not prone to leakage. It is desirable that this device is simple and economical to manufacture, and easy to transport and use. It is desirable that this device does not require multiple parts that must be assembled and stored. It is also desirable that the nozzle is flexible for ease of use.

SUMMARY OF THE INVENTION

The present inventions generally pertain to devices that assist in transferring pourable matter from containers into capless gas systems. These devices may have flexible nozzles.

In a first embodiment the pouring device transfers liquid from a fuel additive container into a capless fuel system intake. An exemplary device has a proximal end including an enlarged mouth portion, and a distal end having a narrower nozzle portion with a flex region. The mouth portion terminates in a flange that flexes inwardly towards the nozzle when a container neck is pushed in, thereby forming a substantially leak-proof frictional engagement between the device and the container. Due to the slight elasticity of the flange, presence of hinge points, and ability of flange to flex inwardly, the device can be used with container necks having a range of different diameters.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers shall apply:

10—pouring device;
12—nozzle;
13—mouth;
14—hinge points;
15—angled transition;
16—flange;
17—aperture;
18—container;
19—neck;
20—flowing liquid;
22—nozzle opening;
28—container threads;
29—container cap;
34—capless fuel system inlet;
36—capless fuel system opening flap;
50—flexible region;
52—bellow;
54—rigid region;
60—distal end;
64—distal threads; and
70—proximal end.

Figure 1:
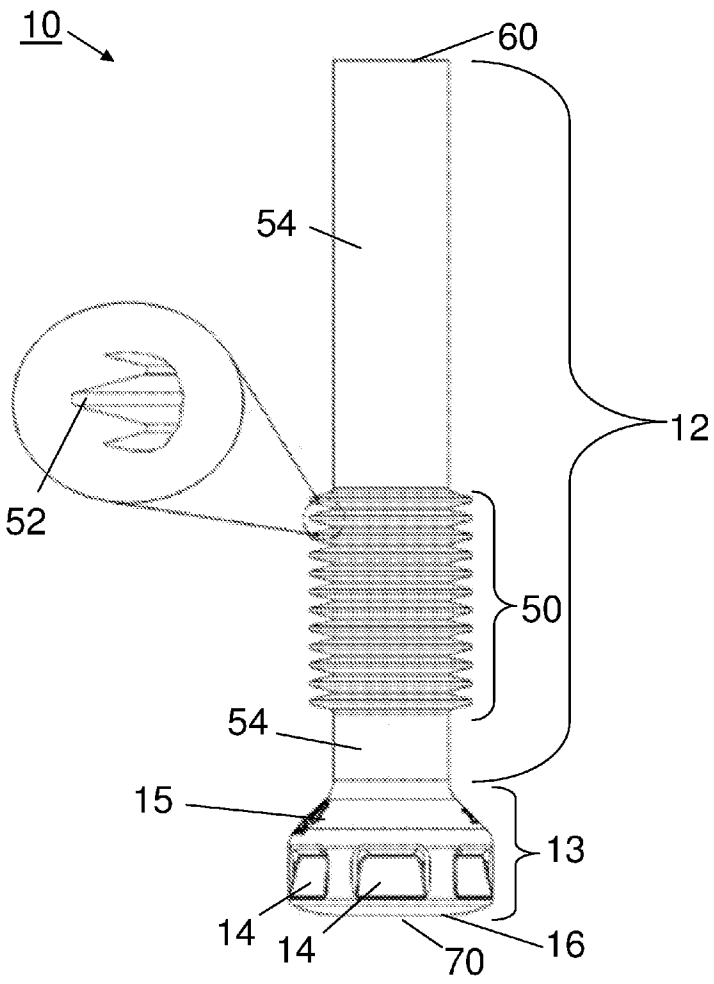
FIG. 1 depicts a pouring device with a blowout view of a bellow.
Figure 4:
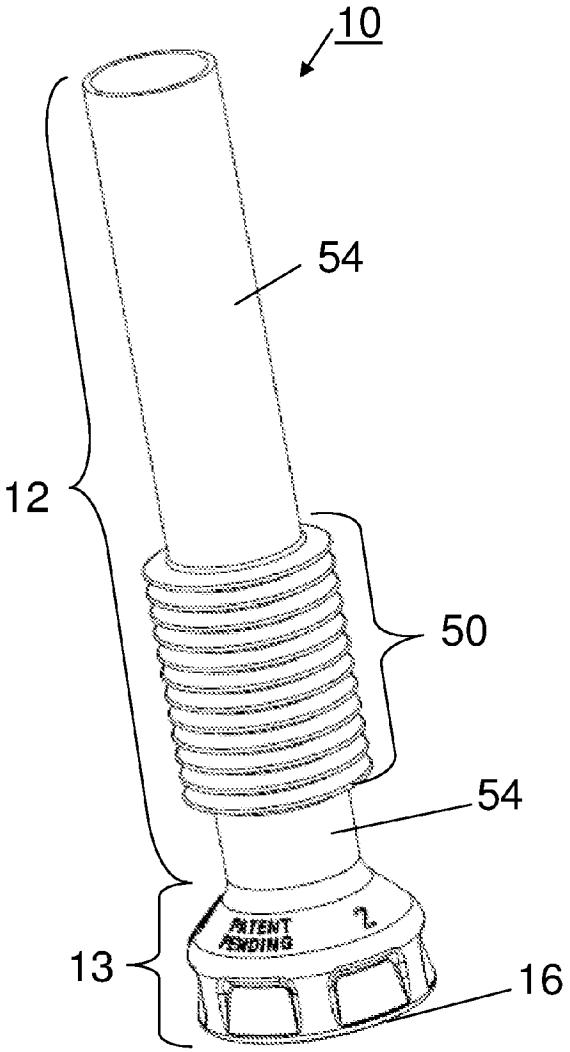
FIG. 4 is a front perspective view of a pouring device.
Figure 2:
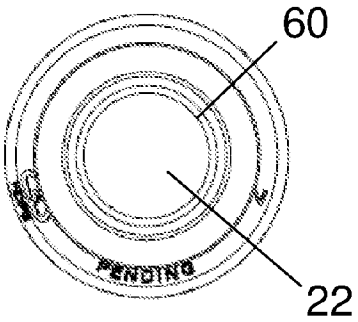
FIG. 2 is a top view of the fuel additive pouring device.
Figure 3:
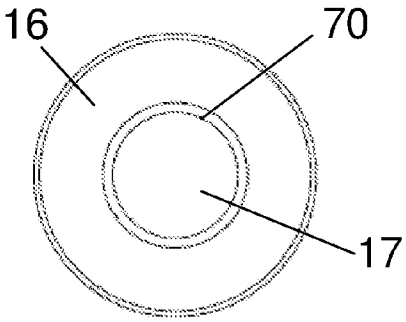
FIG. 3 is an engineering drawing depicting the bottom view of a pouring device.

Referring to FIG. 1, pouring device 10 generally includes cylindrical nozzle 12 terminating in distal end 60; and mouth 13 terminating in proximal end 70. Nozzle 12 may include flexible region 50.

Figure 5:
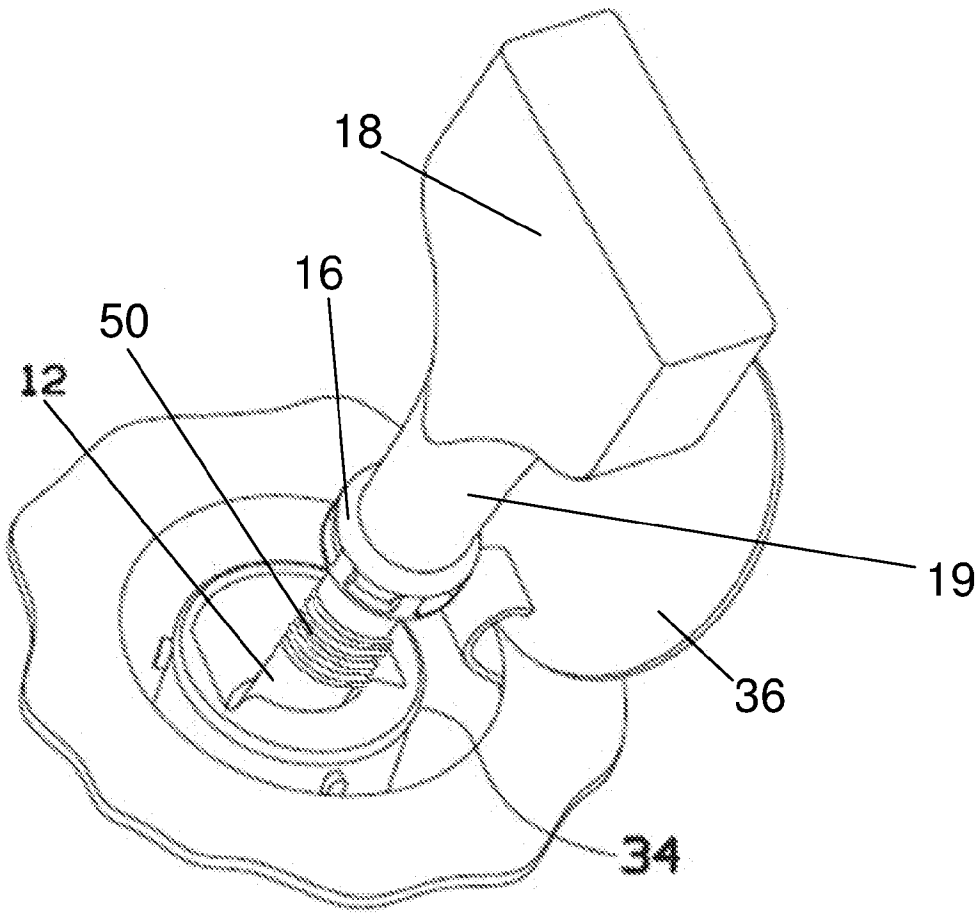
FIG. 5 is a perspective view of a pouring device in use.
Figure 7:
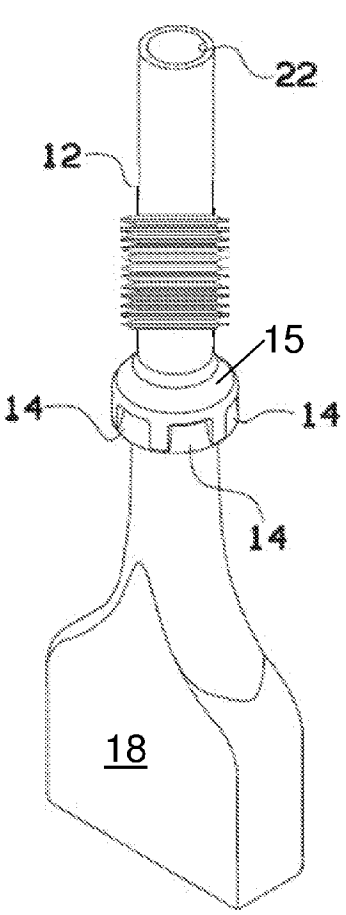
FIG. 7 is a view of a pouring device attached to a fuel additive container.
Figure 6:
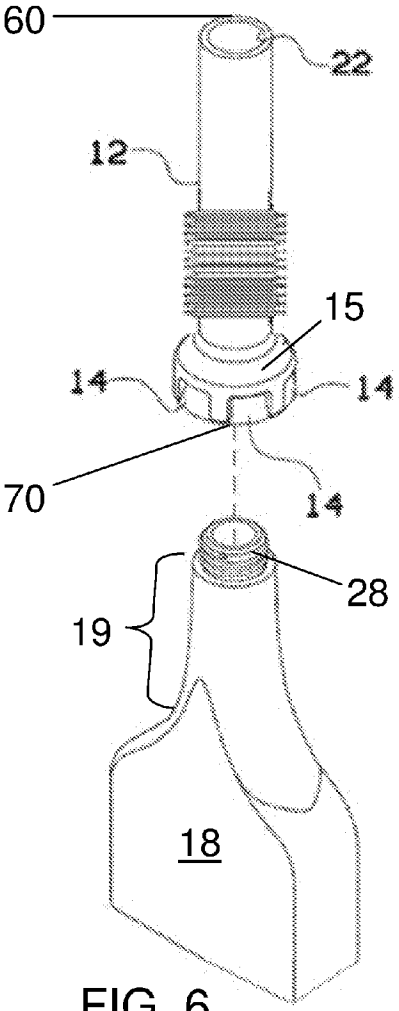
FIG. 6 is a view of a pouring device unattached to a fuel additive container.

As shown in FIGS. 6 and 7, pouring device 10 engages with container 18, for subsequent insertion of nozzle 12 into capless fuel system inlet 34, as shown in FIG. 5. An example of a capless fuel system is Ford Motor Company's EASY FUEL® system. As used herein, "pourable matter" refers to substances, such as liquids, semi-solids, particulates, and the like, which can be poured. Also, "fuel additives" generally refer to liquids and semi-solids that are added to a fuel system.

Figure 9:
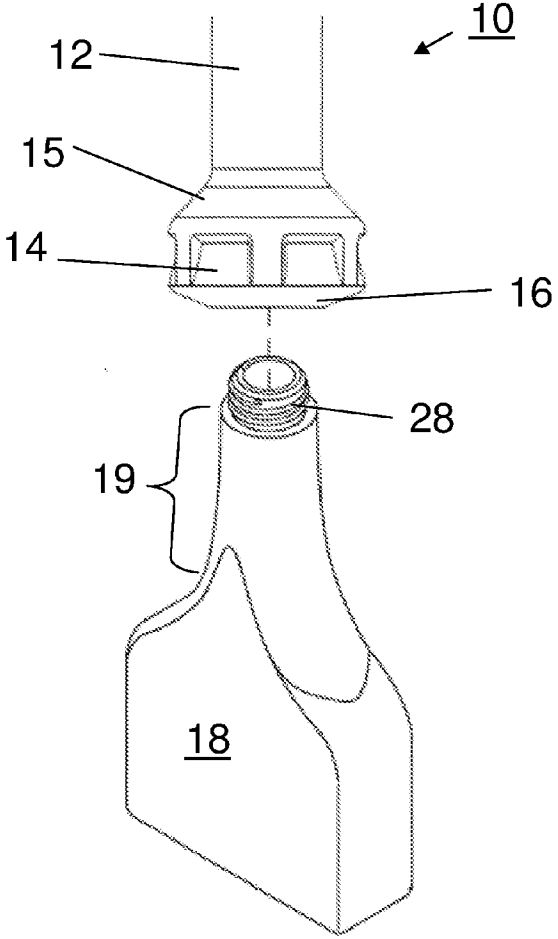
FIG. 9 depicts a pouring device with no container inserted having a flange angled in a direction away from the nozzle.
Figure 10:
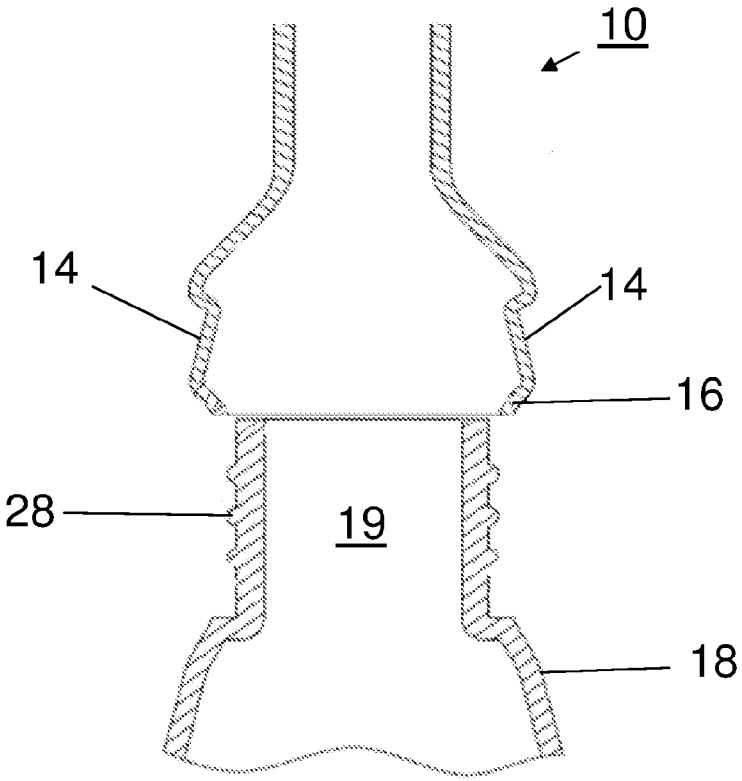
FIG. 10 depicts a pouring device with a container not yet inserted having a flange angled in a direction away from the nozzle.
Figure 11:
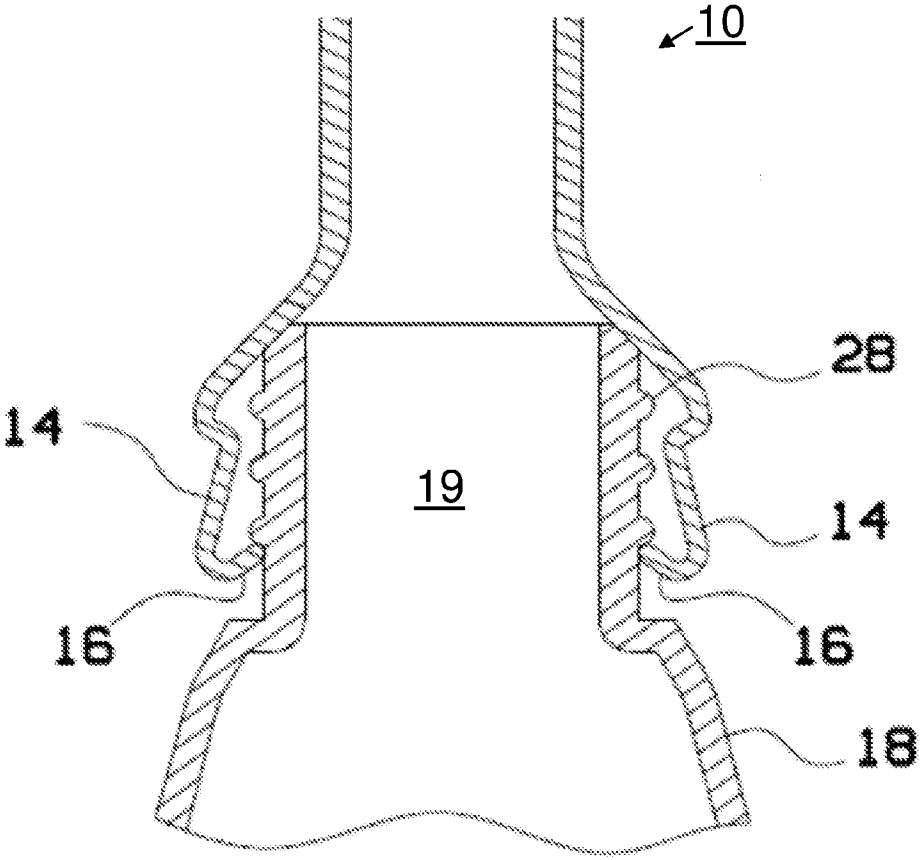
FIG. 11 depicts a pouring device with a container inserted, showing the flange angled in a direction towards the nozzle.
Figure 12:
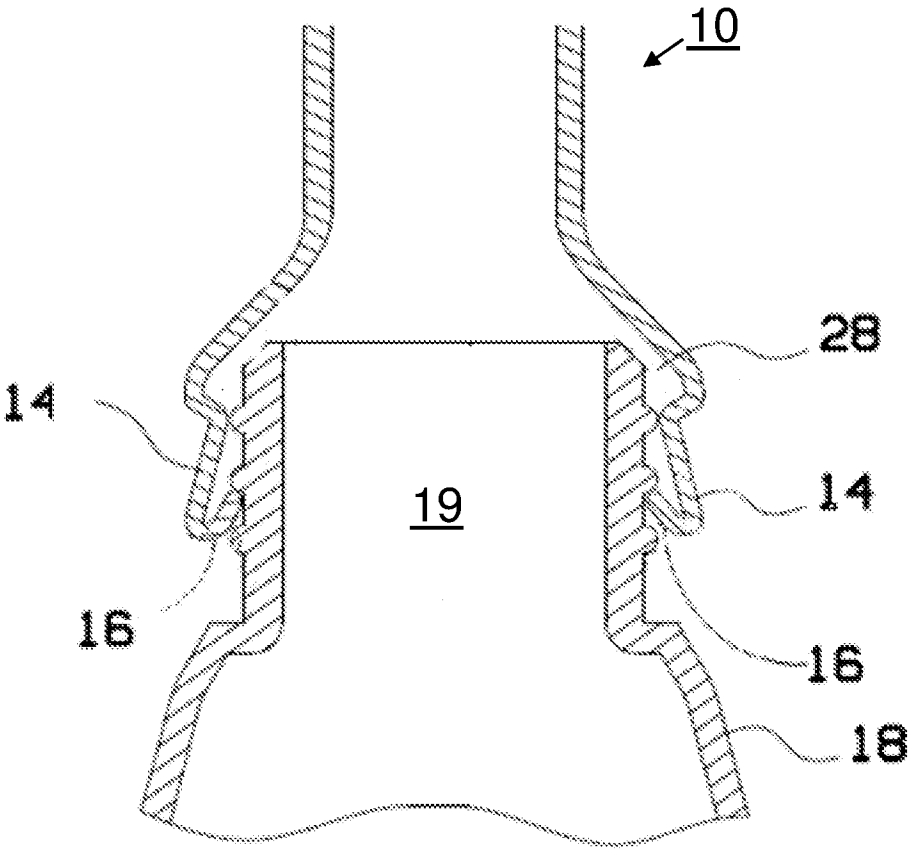
FIG. 12 depicts a pouring device with a wide container inserted, showing the flange angled in a direction towards the nozzle.
Figure 13:
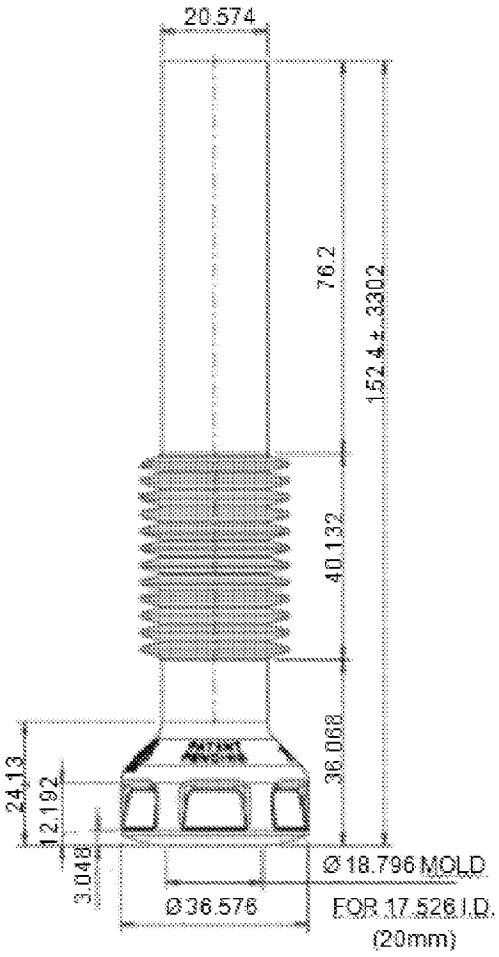
FIG. 13 illustrates dimensions of an embodiment.

Engagement and disengagement of pouring device 10 with fuel additive container 18 is deemed detachable engagement insofar as pouring device 10 forms a frictional connection with container 18, such that the assembly can be inverted for use and pouring without pouring device 10 inadvertently disengaging from container 18, but said engagement isn't so strong that pouring device 10 can't be removed using moderate human strength. When device is not in use, such as FIG. 9, flange 16 is angled in a direction away from nozzle 12. However, as shown in FIG. 11, flange 16 is angled in a direction towards nozzle 12 upon insertion of the container neck 19 into mouth of device 10. Said another way, the flange flexes inwardly when receiving a container neck, which facilitates a close and leak-proof connection. Flange 16 is an annulus, defining a circular aperture within, and is positioned at the very far end of the mouth.

Figure 8:
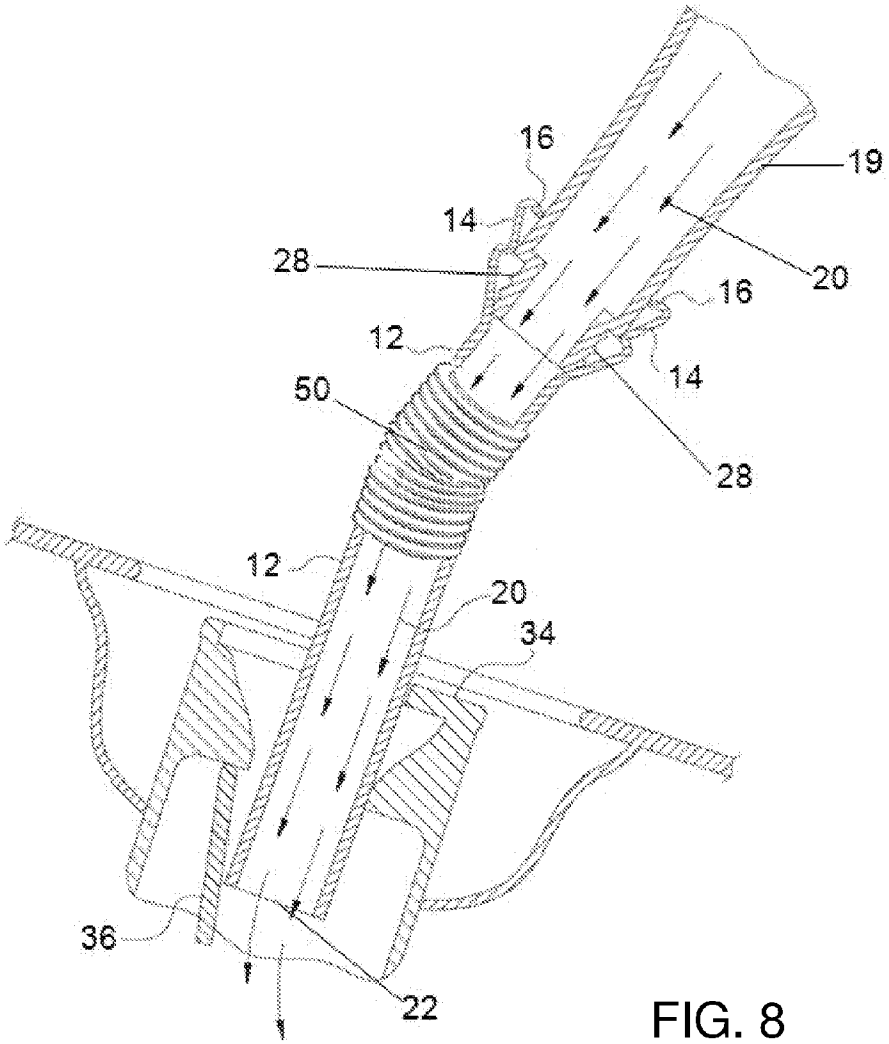
FIG. 8 depicts a pouring device transferring liquid into a cross-sectional view of a capless fuel system.

Referring back to FIG. 1. proximal portion of pouring device 10 forms mouth 13 into which container 18 is inserted. Flange 16 may engage with neck 19 of container 18 as shown in FIG. 8. Alternatively, and depending on the configuration of container 18, flange may engage with container threads 28, as shown in FIG. 11.

Upon successful engagement of pouring device 10 with container 18, the system is inverted, inserted into capless fuel system inlet 34, and pushed downward so opening flap 36 is maintained in opened position, as shown in FIG. 5. Flowing fuel additive 20 is then transferred from container 18 into vehicle. This is shown in FIG. 8.

Flange 16 defines aperture 17 at proximal end 70 of pouring device 10. As shown in FIG. 6, distal end 60 is the pouring end of the device. Aperture desirably has a diameter of approximately 19 mm to 22 mm, with 20 mm to 21 mm being most desired. In use, however, this aperture can expand to have a diameter of approximately 25 mm. The limits of expansion do not permit damage to structural integrity pouring device 10, as such damage could permit leakage or lessen frictional hold with container. In other words, there can't be ripping, cracking and so forth to device.

This expansion is facilitated by hinge points 14 around perimeter of mouth. It is desirable that each pouring device 10 includes a plurality of recessed rectangular hinge points 14, preferably from 4 to 60 hinge points, with 6 hinge points most preferred. It is desirable that each hinge point is angled inwardly towards nozzle 12 to accommodate an appropriate balance between structural integrity and flexibility. While the circumference of the mouth is adjustable to accommodate various sized containers' necks, nozzle 12 preferably has a fixed circumference.

Between cylindrical nozzle 12 and mouth 13 is angled transition 15, which extends inwardly going from mouth to nozzle. Nozzle 12 has a diameter of approximately 20.57 mm, and a length of approximately 100 mm, and is termed an elongated nozzle because the length of the hollow portion is greater than the diameter of the hollow portion. In the embodiment having flexible region 50, the non-flexible regions of the nozzle, rigid regions 54, have a diameter of approximately 20.57 mm. The length of the nozzle is approximately 128 mm when the flex region is in the neutral orientation.

Mouth 13 defines a shortened cylinder, so named because the longitudinal length of the hollow portion is less than the diameter of the hollow portion. Diameter of elongated hollow portion is less than diameter of shortened hollow portion. Mouth desirably has a diameter of approximately 21.7 mm, and a length of approximately 10 mm.

Pouring device 10 may include flex region 50, which is preferably positioned between two rigid regions 54, and is constructed of a plurality of bellows 52. Device preferably includes 5 to 25 bellows, with approximately 12 bellows being preferred. It is desirable that the bellows constitute approximately 25 mm of the nozzle when in the compressed state, but expand to a length of approximately 50 mm in the expanded state, and about 40 mm in the neutral state. Preferably flexible region 50 is positioned completely within the bottom half of nozzle 12 thereby allowing access into capless systems by the upper smooth section of the nozzle. More specifically it is desirable that lower rigid region 54 is approximately 36 mm, and upper rigid region 54 is approximately 72 mm. It is also preferable that the bellows are collapsible bellows which will stay in a bent position unassisted, akin to a bendable straw.

Pouring device 10 desirably has a unitary construction, such as that achieved by blow molding. Suitable materials include high density polyethylene and low density polyethylene, with a blend of seventy five percent (75%) high density polyethylene and twenty five percent (25%) low density polyethylene being most preferred. An example of an appropriate high density polyethylene is Paxon, commercially available from Exxon Mobile Chemical of Lagrange, Ga. An example of an appropriate low density polyethylene is Paxothene, commercially available from Lyondellbasell Industries of Cincinnati, Ohio. It is desirable that the blend and type of materials used constitute the appropriate thickness of the form so as to provide enough rigidity to perform as desired.

It may be desirable for circumference of final 10-15 mm of distal end 60 to be slightly thicker than remainder of nozzle in order to provide greater rigidity. Also, it may be desirable for flange 16 to be constructed of slightly thinner material for improved part deflection. Also, it may be desirable for mouth 13 or hinge points 14 to be shorter or thinner for improved part deflection.

In use, a user would remove the container cap 29 from container 18, push mouth 13 of pouring device 10 over neck 19 so pouring device is engaged with container and flange 16 forms a seal with neck, insert nozzle 12 into capless fuel system inlet 34 and urge inward until capless fuel system opening flap 36 is bypassed, tilt container and permit flexible region 50 to bend as necessary, and allow flowing liquid 20 to enter fuel system.

It should be understood, of course, that the foregoing relates to exemplary embodiments of the invention and that modifications may be made without departing from the spirit and scope of the invention as set forth in the following claims. It should also be understood that ranges of values set forth inherently include those values, as well as all increments between. In addition, the dimensional ranges may vary based on the overall dimensional characteristics of the associated application of the device.

What is claimed is:

1. A pourable matter delivery system including:

A. A container having a neck defining an opening; and

B. A pouring device having a distal pouring end and a proximal attaching end detachably engaged with said neck, said pouring device including:

i. an elongated nozzle having a flexible region surrounded by two rigid regions, and a fixed circumference at said distal end, ii. an angled transition positioned contiguous to said elongated nozzle, iii. a plurality of inwardly angled hinge points positioned contiguous to said angled transition, and iv. a singular flange positioned contiguous to said plurality of inwardly angled hinge points and forming a terminus of said proximal attaching end, said singular flange defining an aperture and deformable for creating a frictional, non-leakage, releasable hold on said neck, wherein said singular flange is angled in a direction away from said nozzle when said pouring device is attached to said container, and said singular flange is angled in a direction towards said nozzle upon insertion of said neck into said aperture.

2. The pourable matter delivery system of claim 1 wherein said neck includes outwardly directed threads.

3. The pourable matter delivery system of claim 2 wherein said singular flange is engaged with said threads.

4. The pourable matter delivery system of claim 1 wherein said plurality of inwardly angled hinge points are rectangular.

5. The liquid pourable matter delivery system of claim 4 wherein said plurality of inwardly angled hinge points consists of between 4 and 60 hinge points.

6. The liquid delivery system of claim 5 wherein said plurality of inwardly angled hinge points consists of 6 hinge points.

7. A pourable matter delivery device with a distal pouring end and a proximal attaching end including:

A. A nozzle having a flexible region surrounded by two rigid cylindrical regions and defining an elongated hollow portion for pouring, said nozzle having a fixed circumference at said distal end;

B. An angled transition positioned contiguous to said nozzle;

C. A plurality of inwardly angled hinge points positioned contiguous to said angled transition; and D. A singular annular flange positioned contiguous to said plurality of inwardly angled hinge points and forming a terminus of said proximal attaching end, said singular annular flange defining an aperture and deformable to create a frictional, non-leakage, releasable hold with a neck of a container, wherein said singular annular flange is angled in a direction away from said nozzle when said pouring device is not attached to the container, and said singular annular flange is angled in a direction towards said nozzle upon insertion of the neck into said aperture.

8. The pourable matter delivery device of claim 7 wherein said elongated hollow portion has a smaller diameter than said aperture.

9. The pourable matter delivery device of claim 7 wherein said two rigid cylindrical regions each have a diameter of 20.57 mm.

10. The pourable matter delivery device of claim 7 wherein said aperture has a diameter of 19 mm to 25 mm.

11. The pourable matter delivery device of claim 10 wherein the diameter of said aperture can be enlarged by 10% without damaging the structural integrity of said single annular flange.

12. The pourable matter delivery device of claim 7 being constructed of materials selected from the group consisting of high density polyethylene, low density polyethylene and combinations thereof.

13. A device with a distal pouring end and a proximal attaching end for introducing substances into capless fuel systems, said device including:

A. A nozzle sized and shaped to bypass a capless fuel system's opening flap;

B. An angled transition position contiguous to said nozzle;

C. A plurality of double-acting hinge points angled inwardly towards said nozzle and contiguous to said angled transition; and D. An annular flange positioned contiguous to said plurality of double-acting hinge joints and forming a terminus of said proximal attaching end, said annular flange defining an aperture and deformable to create a frictional, non-leaking, detachable engagement with a neck of a container, wherein said annular flange is angled in a direction away from said nozzle when said device is not attached to the neck, and said annular flange is angled in a direction towards said nozzle upon complete insertion of said neck into said aperture.

14. The device of claim 13 wherein said hinge points are substantially rectangular.

15. The device of claim 13 wherein said nozzle further includes a flexible region.

16. The device of claim 15 wherein said flexible region is formed of a plurality of bellows.

17. The device of claim 16 wherein said bellows are positioned on the lower half of said nozzle.

18. The device of claim 16 wherein said bellows are collapsible bellows.

* * * * *